US009532651B2

(12) United States Patent
Chung

(10) Patent No.: US 9,532,651 B2
(45) Date of Patent: Jan. 3, 2017

(54) COMBINATION FURNITURE

(71) Applicant: BUDDHA SHENG INTERNATIONAL LTD., Miaoli County (TW)

(72) Inventor: Yu-Wei Chung, Miaoli County (TW)

(73) Assignee: BUDDHA SHENG INTERNATIONAL LTD., Miaoli County (TW)

( * ) Notice: Subject to any disclaimer, the term of this patent is extended or adjusted under 35 U.S.C. 154(b) by 0 days.

(21) Appl. No.: 14/803,524

(22) Filed: Jul. 20, 2015

(65) Prior Publication Data

US 2016/0262542 A1 Sep. 15, 2016

(30) Foreign Application Priority Data

Mar. 13, 2015 (TW) ..... 104108235 A

(51) Int. Cl.
*A47C 4/02* (2006.01)

(52) U.S. Cl.
CPC ..... *A47C 4/021* (2013.01); *A47C 4/028* (2013.01)

(58) Field of Classification Search
CPC ..... A47C 4/021; A47C 4/028
USPC ..... 297/440.22, 440.14
See application file for complete search history.

(56) References Cited

U.S. PATENT DOCUMENTS 3,183,036 A * 5/1965 Hill ..... A47C 4/02 297/440.22
4,077,666 A * 3/1978 Heumann ..... A47C 13/005 297/440.14
5,890,767 A * 4/1999 Chang ..... A47C 4/02 297/440.14 X

* cited by examiner

*Primary Examiner* — Anthony D Barfield
(74) *Attorney, Agent, or Firm* — WPAT, P.C., Intellectual Property Attorneys; Anthony King

(57) ABSTRACT

A combination furniture includes a base, a main cushion, two armrests, a backrest, and a fastener assembly. The top surface of the base is concavely provided with plural strip-shaped coupling grooves. The main cushion has a bottom plate provided with plural coupling strips integrally projecting from the bottom plate for being coupled with the coupling grooves. The two armrests have a pair of combining parts formed in parallel and slidingly and transversely installed on two sides of the base, respectively. The backrest has a pair of fixing parts formed on the backrest in parallel for correspondingly overlapping the two combining parts of the two armrests. The fastener assembly fastens the combining parts and the corresponding fixing parts to the base. Therefore, the combination furniture is easily assembled, manufactured, and transported.

9 Claims, 7 Drawing Sheets

COMBINATION FURNITURE

BACKGROUND OF THE INVENTION

1. Field of the Invention

The present invention relates to furniture, and more particularly, to a combination furniture.

2. Description of the Related Art

Traditional furniture usually is integrally made in one piece; however, due to the large volume thereof, inconvenience for transportation is caused. When damage upon the furniture during transportation is occurred, the furniture needs to be repaired by skilled professional; also, maintenance fee thereof is high.

Thus, combination furniture is created and on available in the market, while such combination furniture is assembled mainly by use of metal skeletons and attachments fastened up together, thereby facilitating the transportation process. However, volume of the skeletons of tradition furniture remains large which is unfavorable for sole manufacture. Also, when such combination furniture is damaged, the damaged parts are not able to be simply replaced and only allowed to be repaired by skilled professionals, such that maintenance fee remains high.

Therefore, the prevent invention aims at improving known disadvantages of traditional furniture.

SUMMARY OF THE INVENTION

For improving the aforementioned issues, embodiments of the present invention discloses a combination furniture, wherein the main cushion, armrest, and backrest are independently manufactured by molding, and subsequently assembled on a base, allowing larger assembling variability and facilitating the assembling, transportation, and maintenance.

For achieving the aforementioned objectives, embodiments of the present invention provide a combination furniture, comprising:

a base, concavely provided with plural strip-shaped coupling grooves on a top surface thereof;

a main cushion, having a bottom plate and plural coupling strips projecting from the bottom plate, the coupling strips integrally and equidistantly formed on the bottom plate and coupled with the coupling grooves;

two armrests, a pair of combining parts formed on each of the two armrests in parallel and slidingly and transversely installed on two sides of the base, respectively;

a backrest, a pair of fixing parts formed on the backrest in parallel and correspondingly overlapping the two combining parts of the two armrests; and a fastener assembly, fastening the combining parts and the fixing parts to the base.

Therefore, embodiments of the present invention facilitate the assembling, manufacturing, and transportation process of the combination furniture.

For achieving the aforementioned objectives, embodiments of the present invention provide another combination furniture, comprising:

a first base, concavely provided with plural strip-shaped first coupling grooves on a top surface thereof;

a second base, disposed in parallel to the first base, concavely provided with plural strip-shaped second coupling grooves on a top surface thereof;

a first cushion, having plural first coupling strips equidistantly projecting from a bottom surface of the first cushion to couple with the first coupling grooves;

a second cushion, having plural second coupling strips equidistantly projecting from a bottom surface of the second cushion to couple with the second coupling grooves; and at least a connecting member, engaged between the first base and the second base.

With such configuration, the combination furniture is easily assembled and provided with stable structure. Also, the elements are allowed to be renewed by the user, so as to lower the maintenance fee.

DETAILED DESCRIPTION OF THE INVENTION

Figure 1:
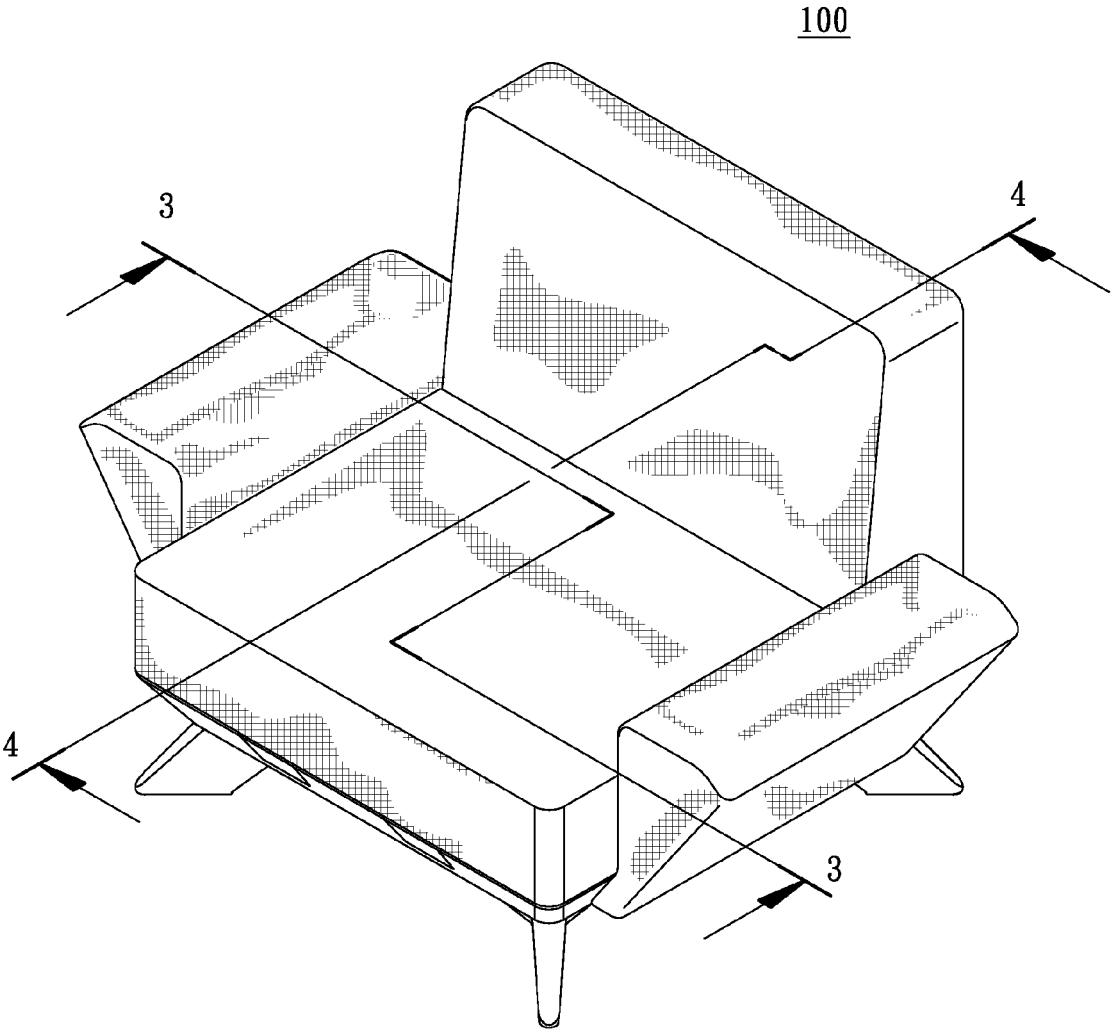
FIG. 1 is a perspective view of the combination furniture in accordance with an embodiment of the present invention.
Figure 2:
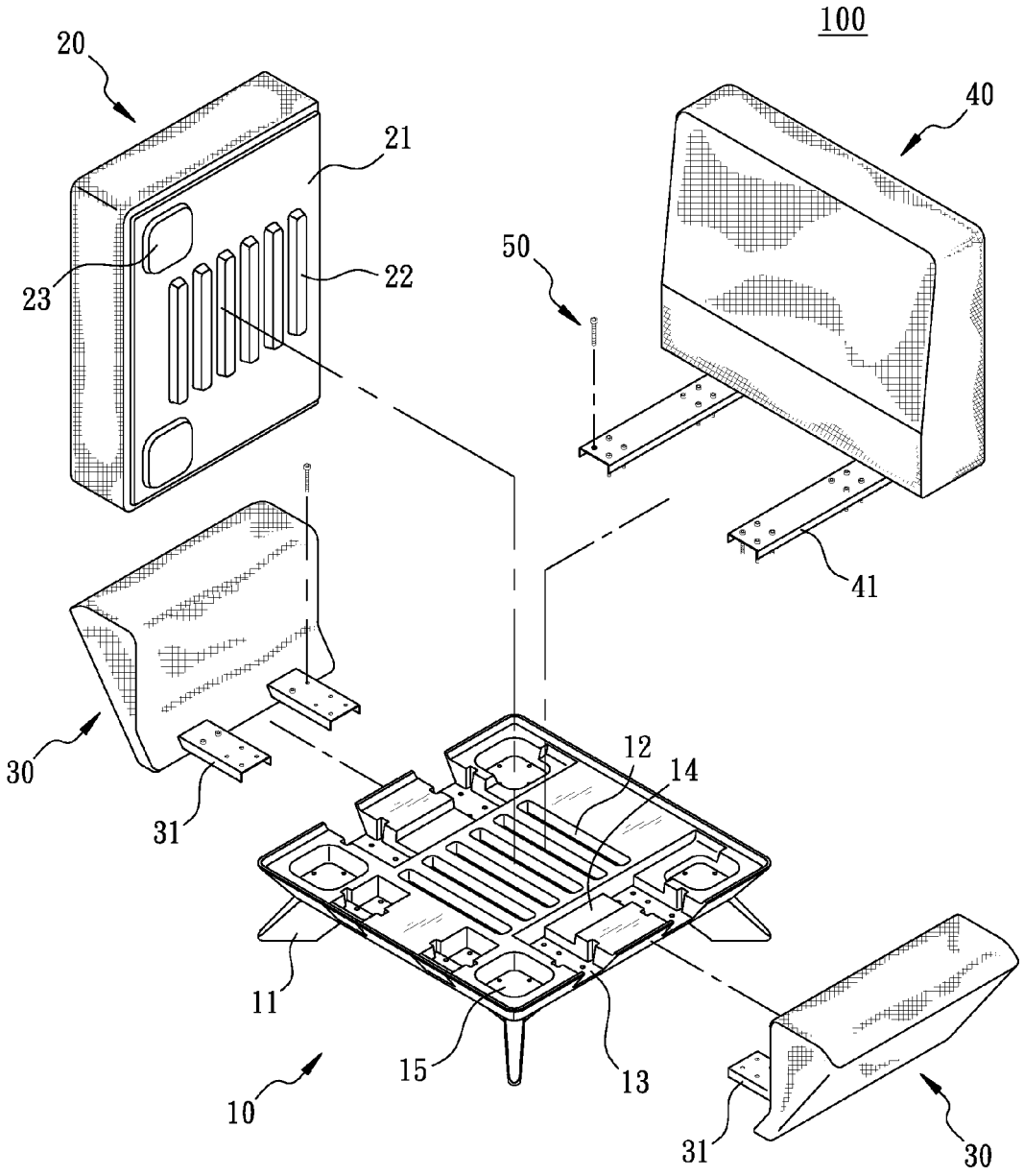
FIG. 2 is an exploded view of an embodiment in accordance with the present invention.
Figure 3:
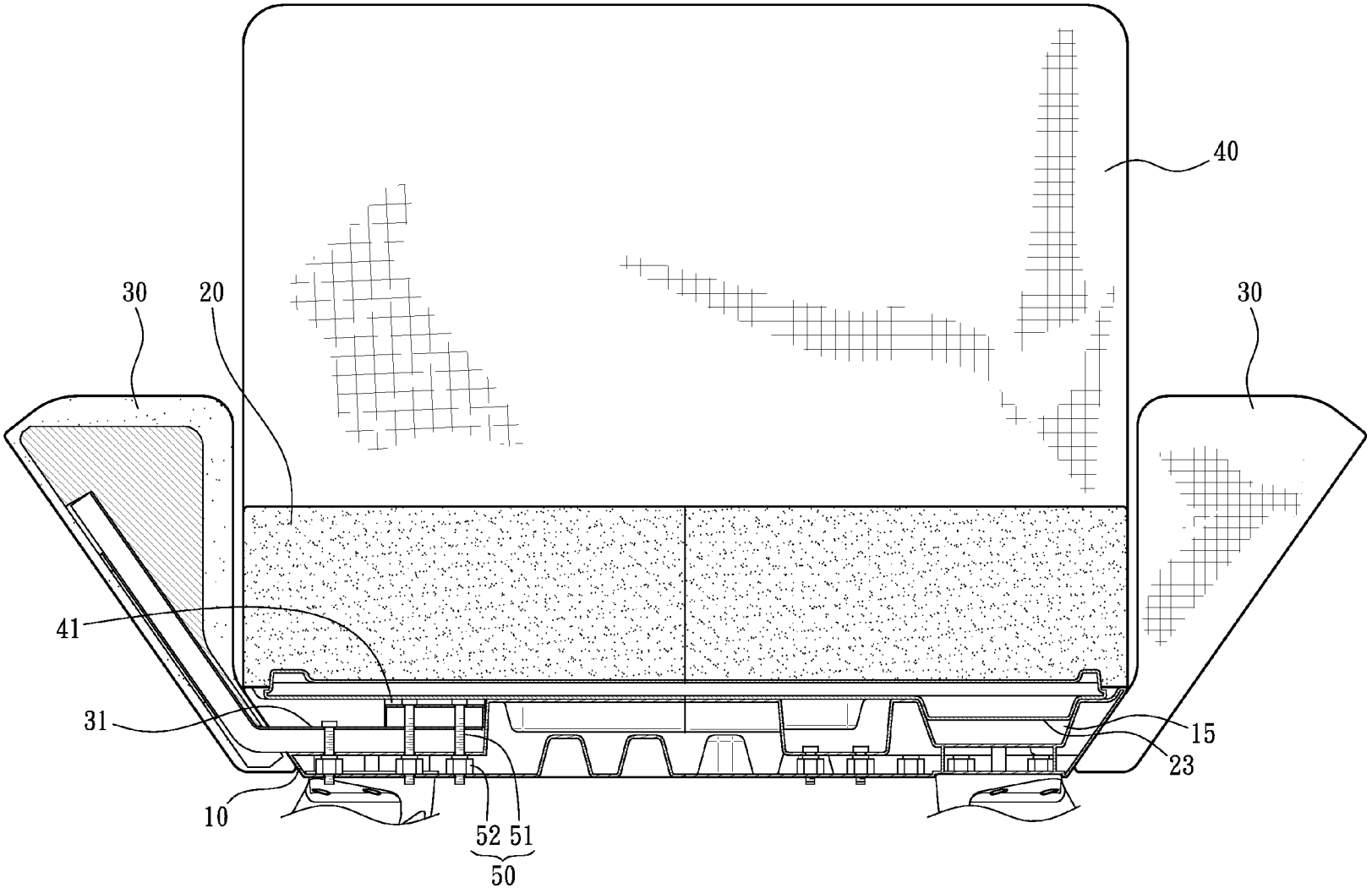
FIG. 3 is a cross-sectional view taken along 3-3 in FIG. 1.
Figure 4:
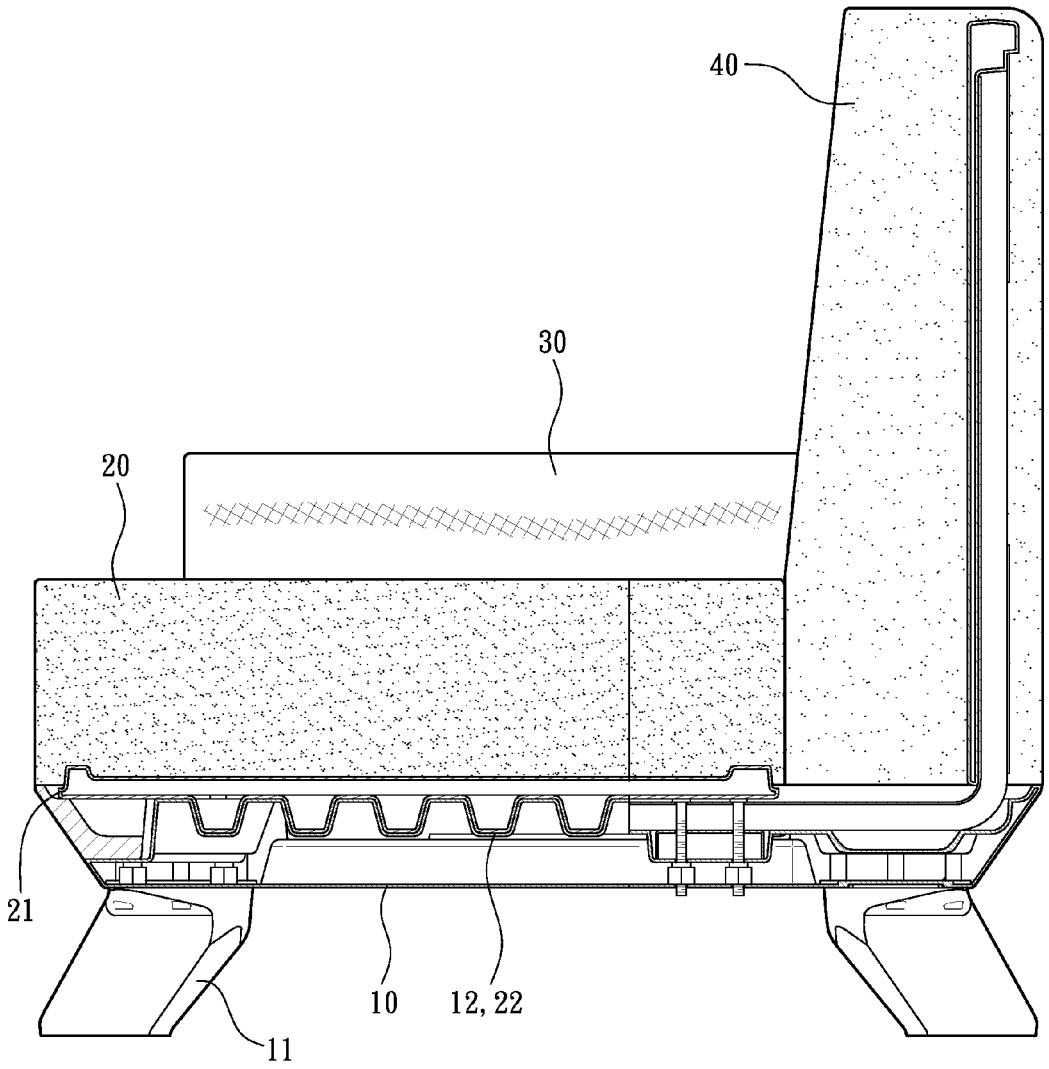
FIG. 4 is a cross-sectional view taken along 4-4 in FIG. 1.

The aforementioned and further advantages and features of the present invention will be understood by reference to the description of the preferred embodiment in conjunction with the accompanying drawings where the components are illustrated based on a proportion for explanation but not subject to the actual component proportion.

Referring to FIG. 1 to FIG. 4, a combination furniture 100 provided by an embodiment of the present invention is a single sofa, including a base 10, a main cushion 20, two armrests 30, and a backrest 40.

The base 10 has four foots 11 disposed at the four corners thereof. The top surface of the base 10 is provided with plural coupling grooves 12 equidistantly disposed. The plural coupling grooves 12 are sandwiched by two pair of sliding grooves 13, with one containing groove 14 vertically disposed upon each pair of the sliding grooves 13, respectively, wherein the length of each containing grooves 14 is smaller than the width of the edge of the base 10 in parallel to the containing grooves 14. Additionally, at least a positioning recess 15 is concavely disposed at a corner of the base 10.

The main cushion 20 has a bottom plate 21 having plural coupling strips 22 equidistantly and integrally projecting from the bottom plate 21 for coupling the coupling grooves 12, such that the main cushion 20 is stably combined to the top surface of the base 10. The bottom plate 21 is formed of metal material, and the coupling strips 22 are formed in a hollow structure. Further, the bottom surface of the main cushion 20 is provided with at least a positioning block 23; in the embodiment of the present invention, two positioning blocks 23 are provided for receiving the positioning recesses 15, such that the main cushion 20 is positioned at the top surface of the base 10.

A pair of strip-shaped combining parts 31 horizontally extends from each of the two armrests 30, wherein the each of the combining parts 31 is formed in a reversed U shape, such that each pair of the combining parts are transversely and slidingly disposed on two sides of the base 10, respectively. Preferably, each armrest 30 is slidingly disposed in the corresponding sliding grooves 13 by use of the combining parts 31 and fixed to the both sides of the base 10 through bolts, such that arms of the user are held by the armrests 30.

The backrest 40 has a pair of strip-shaped fixing part 41, and each of the fixing parts 41 is further formed in a reversed U shape for being installed in the containing groove 14 of the base 10, whereby each of the fixing parts 41 overlaps the two combining parts 31 of the corresponding armrests 30, forming a layer structure. With such configuration, numbers of installation grooves of the base 10 are reduced, thus lowering the cost of material and molding.

A fastener assembly 50 is applied for fastening each pair of the combining parts 31 and the corresponding fixing part 41 to the base 10. The fastener assembly 50 includes plural bolts 51 and nuts 52. The bolts 51 pass through the fixing part 41, the corresponding combining parts 30 and the base 10, and the nuts 52 are applied for further fastening such structural configuration.

The base 10, main cushion 20, armrests 30, and backrest 40 are independently manufactured by molding, so that the general volume before assembling is smaller, facilitating the transportation process. During the assembling process, the coupling strips 22 of the main cushion 20 are coupled with the coupling grooves 12 of the base 10. The fixing part 41 of the backrest 40 overlaps the combining parts 31 of the corresponding armrest 30, and the fastener assembly 50 fixes the fixing part 41 and the combining parts 31 to the base 10. The assembling process is simple, and the structural strength is provided. When components are damaged, user is allowed to simply renew the damaged components without the necessity of maintenance by skilled professionals, thus lowering the cost of maintenance.

Figure 5:
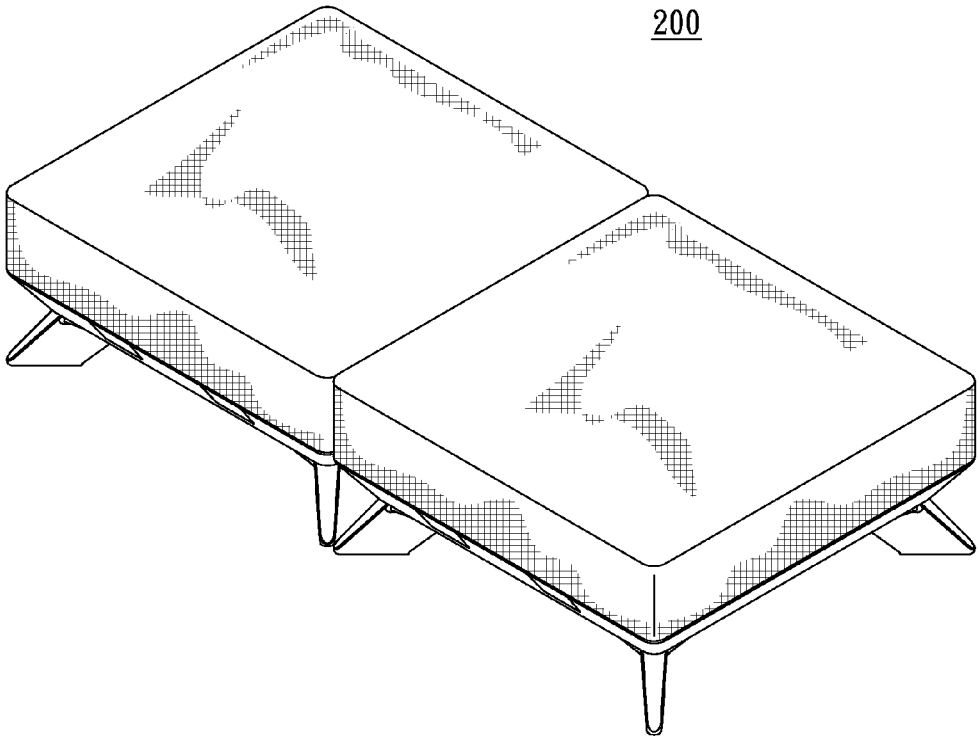
FIG. 5 is a perspective view of a second embodiment in accordance with the present invention.
Figure 6:
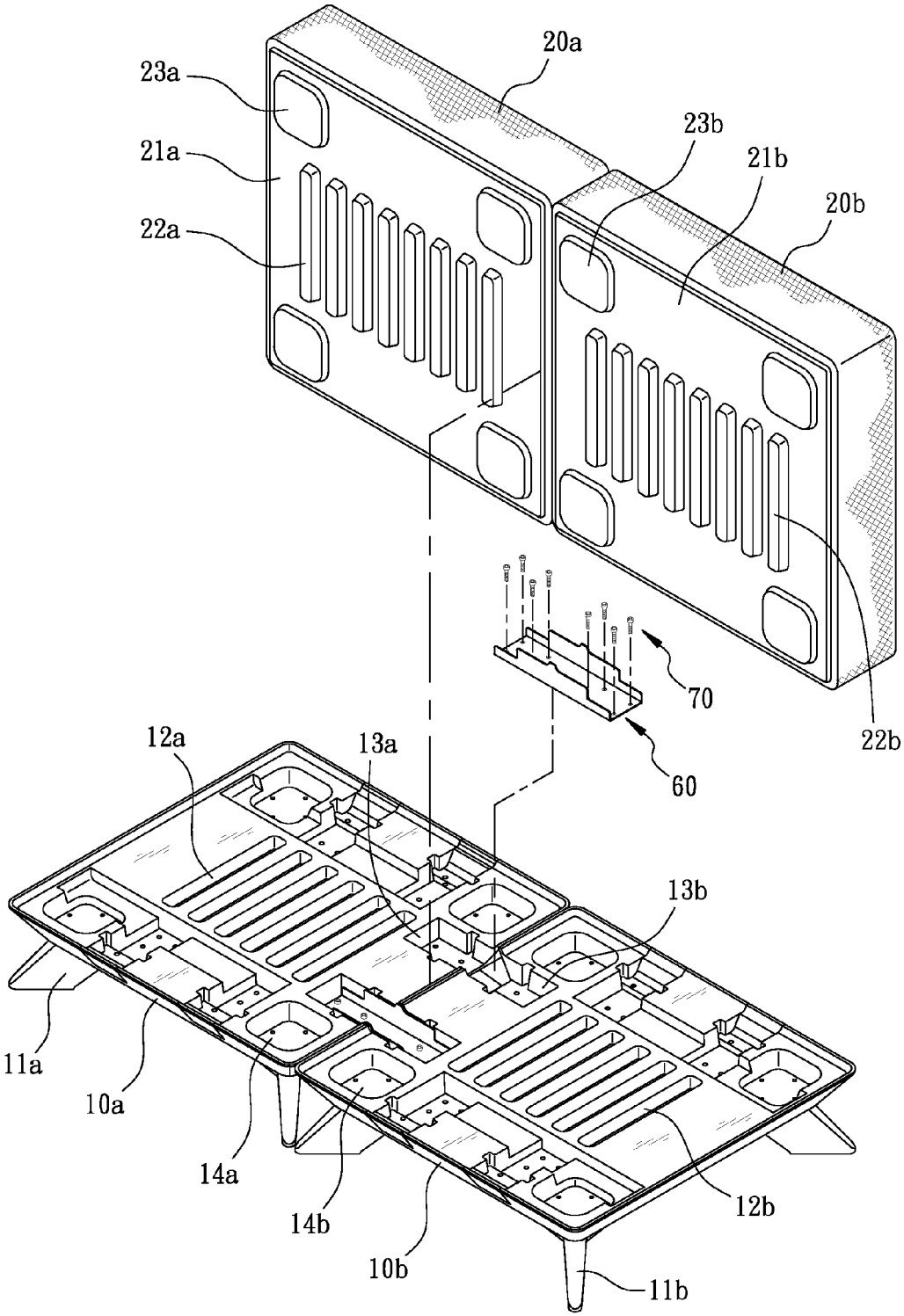
FIG. 6 is an exploded view of the second embodiment in accordance with the present invention.
Figure 7:
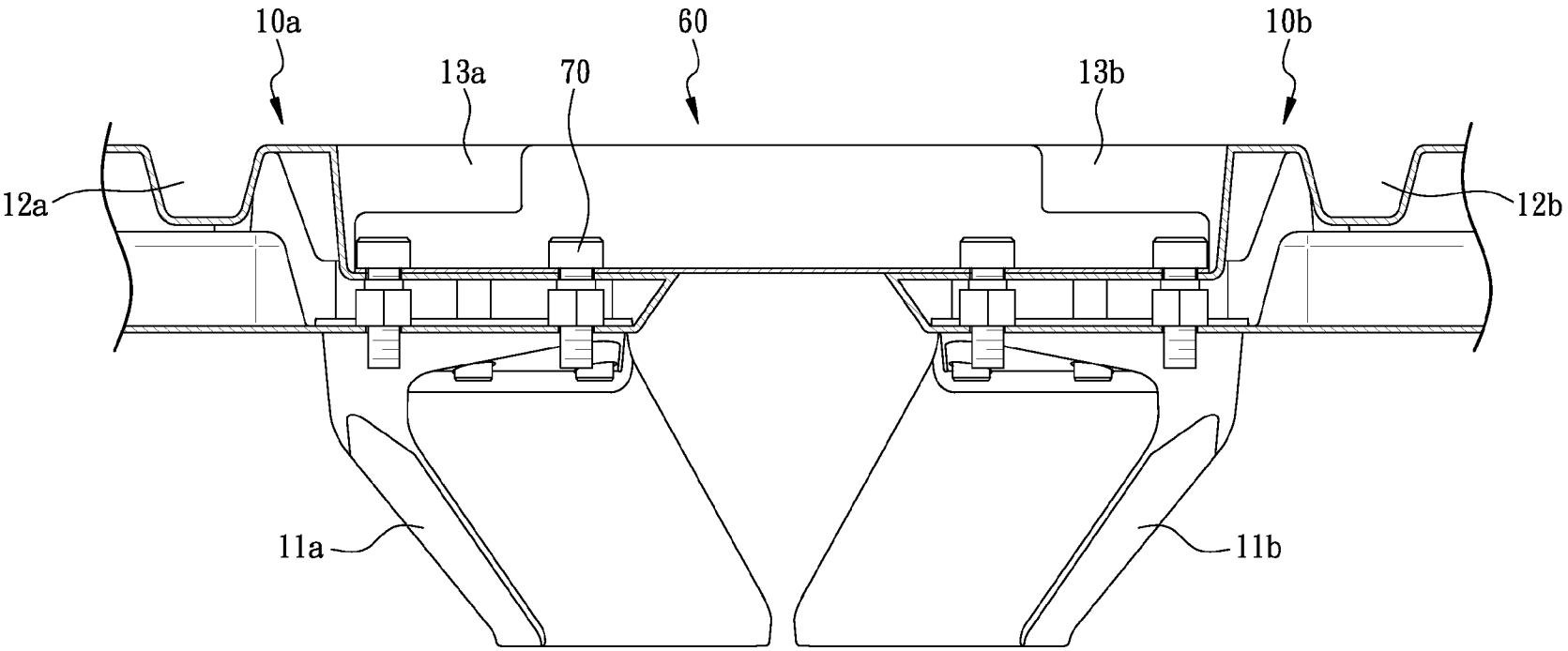
FIG. 7 is a partial sectional view of the second embodiment in accordance with the present invention.

Referring to FIG. 5 to FIG. 7, another embodiment of the combination furniture 200 is performed in a bed cushion, including a first base 10*a*, a second base 10*b*, a first cushion 20*a*, a second cushion 20*b*, and at least one connecting member 60.

The first base 10*a* is structurally similar to the aforementioned base 10, wherein the first base 10*a* has four foots 11*a* disposed at the four corners thereof. The top surface of the base 10*a* is provided with plural coupling grooves 12*a* equidistantly disposed. One side of the plural coupling grooves 12*a* is provided with a pair of connecting grooves 13*a*. Also, the base 10*a* has a positioning recess 14*a* disposed at two corners of each side of the base 10*a*.

The second base 10*b* is disposed side by side with the first base 10*a* and structurally identical to the first base 10*a*. The top surface of the base 10*b* is provided with plural coupling grooves 12*b* equidistantly disposed. One side of the plural coupling grooves 12*b* is provided with a pair of connecting grooves 13*b* corresponding to the connecting grooves 13*a* of the first base 10*a*. Also, the base 10*b* has a positioning recess 14*b* disposed at two corners of each side of the base 10*b*.

The first cushion 20*a* is structurally identical with the aforementioned main cushion 20. The first cushion 20*a* has a bottom plate 21*a* equidistantly provided with plural first coupling strips 22*a* for coupling the coupling grooves 12*a* of the first base 10*a*, whereby the first cushion 20*a* is stably combined to the top surface of the first base 10*a*. The bottom surface of the first cushion 20*a* has two positioning blocks 23*a* for receiving the positioning recesses 14*a* of the first base 10*a*.

The second cushion 20*b* is structurally identical with the aforementioned first cushion 20*a*. The second cushion 20*b* has a bottom plate 21*b* equidistantly provided with plural second coupling strips 22*b* for coupling the coupling grooves 12*b* of the second base 10*b*, whereby the second cushion 20*b* is stably combined to the top surface of the second base 10*b*. The bottom surface of the second cushion 20*b* has two positioning blocks 23*b* for receiving the positioning recesses 14*b* of the second base 10*b*.

The at least one connecting member 60 is engaged between the first base 10*a* and the second base 10*b*. Preferably, two connecting members 60 are applied, wherein each connecting member 60 is formed in a reversed U shape, and two ends of each connecting member 60 are received in the connecting groove 13*a* of the first base 10*a* and the connecting groove 13*b* of the second base 10*b*, respectively. Plural bolts 70 are applied to fasten the connecting member 60 to the connecting groove 13*a* and connecting groove 13*b*, so as to combine the first base 10*a* and the second base 10*b* in order to form a bed cushion structure for the user to sit or lie thereon.

With such simple configuration, the two bases are combined and fastened to each other, achieving a variation of the furniture. Also, cost of manufacture is lowered, and the transportation and assembling processes are facilitated.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A combination furniture, comprising:

a base, concavely provided with plural strip-shaped coupling grooves on a top surface thereof, at least one positioning recess concavely disposed at a corner of the base;

a main cushion, having a bottom plate provided with plural coupling strips projecting from the bottom plate, the coupling strips integrally and equidistantly formed on the bottom plate and coupled with the coupling grooves, the main cushion further provided with at least one positioning block on a bottom surface thereof, the at least one positioning block received by the at least one positioning recess of the base;

two armrests, a pair of combining parts formed on each of the two armrests in parallel and slidingly and transversely installed on two sides of the base, respectively;

a backrest, a pair of fixing parts formed on the backrest in parallel and correspondingly overlapping the two combining parts of the two armrests, respectively; and a fastener assembly, fastening the combining parts and the corresponding fixing parts to the base.

2. The combination furniture of claim 1, wherein a pair of sliding grooves is disposed on two sides of the coupling grooves, respectively, and the combining parts of the two armrests are slidingly received in the corresponding pair of the sliding grooves, respectively.

3. The combination furniture of claim 2, wherein a containing groove is vertically disposed upon each pair of the sliding grooves, respectively, and receives one of the two fixing parts of the backrest.

4. The combination furniture of claim 1, wherein each of the combining parts is formed in a reversed U shape.

5. The combination furniture of claim 1, wherein each of the fixing parts is formed in a reversed U shape.

6. The combination furniture of claim 1, wherein each of the coupling strips is formed in a hollow shape.

7. A combination furniture, comprising:

a first base, concavely provided with plural strip-shaped first coupling grooves on a top surface thereof, at least one positioning recess concavely disposed at a corner of the first base;

a second base, disposed in parallel to the first base, and concavely provided with plural strip-shaped second coupling grooves on a top surface thereof, at least one positioning recess concavely disposed at a corner of the second base;

a first cushion, having plural first coupling strips equidistantly projecting from a bottom surface of the first cushion, and the first coupling strips correspondingly coupled with the first coupling grooves, the first cushion further provided with at least one positioning block on a bottom surface thereof, the at least one positioning block of the first cushion received by the at least one positioning recess of the first base;

a second cushion, having plural second coupling strips equidistantly projecting from a bottom surface of the second cushion, and the second coupling strips correspondingly coupled with the second coupling grooves, the second cushion further provided with at least one positioning block on a bottom surface thereof, the at least one positioning block of the second cushion received by the at least one positioning recess of the second base; and at least one connecting member, engaged between the first base and the second base.

8. The combination furniture of claim 7, wherein the at least one connecting member is formed in a strip shape and a reversed U shape.

9. The combination furniture of claim 7, the first base and the second base is provided with at least one connecting groove, such that two ends of the at least one connecting member is received in the at least one connecting groove of the first base and the second base, respectively.

* * * * *